United States Patent [19]

Ibel

[11] 4,215,685

[45] Aug. 5, 1980

[54] TROUSER CONSTRUCTION

[76] Inventor: Manfred Ibel, 178 Fifth Ave., New York, N.Y. 10010

[21] Appl. No.: 908,406

[22] Filed: May 22, 1978

[51] Int. Cl.[2] ..... A41D 1/06; A61F 5/40

[52] U.S. Cl. ..... 128/159; 2/227

[58] Field of Search ..... 2/22, 23, 79, 403–405, 2/227, 234; 128/158–159

[56] References Cited

U.S. PATENT DOCUMENTS

| | | | |
|---|---|---|---|
| 2,285,692 | 6/1942 | Wickman | 2/227 |
| 2,306,514 | 12/1942 | Wilker et al. | 2/227 |
| 2,702,545 | 2/1955 | Orr | 2/227 |
| 3,517,666 | 6/1970 | Atlee | 2/403 |
| 4,035,844 | 7/1977 | Atack et al. | 2/227 |
| 4,068,321 | 1/1978 | Chayer | 2/227 |

*Primary Examiner*—C. Fred Rosenbaum

[57] ABSTRACT

A pair of anatomically fitted trousers with an improved construction of the crotch and front region consisting of the usual leg portions, the usual waistband and a novel combination crotch/front panel. The conventional leg portions with one, two or various seams at any desired location are closely fitted around each upper thigh and buttock, are suspended from the waistline by means of the usual waistband and are joined together at the rear by a medial seam, closely following the contour line of the sagittal section of the pelvis down to a point near the anus. Starting at said point an oblong triangular cutout is provided between said leg portions having two concavely curved long edges and one convexly curved or straight short edge, exposing the perineum and genitals, the pubic area and abdominal area above up to the waistband. Into said triangular cutout the combination crotch/front panel is inserted, acting like a large shallowly cupped hand held over the genitals and acting like an accordion between the leg portions in the perineal area during leg movement, having two oblong convexly curved or straight edges and a short concavely curved or straight edge, being connected along its oblong edges to the leg portions along the long edges of said triangular cutout and along its short edge to the waistband, thus connecting the two leg portions from said point near the anus up to the front portion of the waistband.

6 Claims, 13 Drawing Figures

TROUSER CONSTRUCTION

BACKGROUND OF THE INVENTION

1. Field of the Invention

This invention relates to trouser construction and more particularly to improvements in the construction of the crotch and front region.

2. Discussion of the Prior Art

Prior art falls broadly into the following categories: conventional trousers with a medial crotch seam, starting at the rear and following the crotch line to a frontal point near the genitals, and continuing on up to the frontal portion of the waistband by fashioning a centered fly aperture; other prior art trouser constructions feature the same centered crotch seam to a frontal point near the genitals and locate the fly aperture off-center, in some cases by means of overlapping triangular flaps, extending from or integral with the front sections of the leg portions, as for example in U.S. Pat. Nos. 2,113,732; 3,806,953; 4,068,321. In other cases a simple off-center diagonally directed fly opening is shown, as in U.S. Pat. No. 2,506,411.

The hinge lines for the moveable legs with respect to the stationary mass of the pelvis to which they are fastened are located in the crotch area along the borderlines of the perineum. The female genitals are medially located inside the perineum; the male genitals are medially fastened in front of the perineum to the body mass of the pelvis like a pendulum; as legs and body change their position the male genitals have the natural tendency to hang straight down, pulled by the force of gravity. A centered crotch seam in the construction of closely fitted trousers should be ideally located right up against the perineum for unobstructed leg movement, because it represents the hingeline for the two leg portions, but it would inevitably get into the way of the medially located genitals. A crotch seam located much below the crotch line does not get into the way of the genitals but obstructs leg movement when the leg portions are closely fitted. Low crotch seams can only be used successfully with very loosely fitted trousers; the extra fabric around the legs has to compensate for the restriction imposed on leg movement by a hinge line for the leg portions which does not line up with the natural hinge lines of the legs to which the leg portions are attached. In respect to the male pelvis, the centered conventional crotch seam, located higher than the lowest elevation of the male genitals and a certain distance below the perineum, forces the user to situate the medially suspended genitals alongside one of the thighs, inside the leg portions, off-center left or right of the medial crotch seam, as it rides up and down during leg and body movement. Extra space has to be provided in one of the leg portions: some men are dressing "left", some are dressing "right". This off-centered locationing of the medially located male genitals in respect to a centered crotch seam creates unpleasant friction and pulling of fabric against the genitals as they are forced against the gravitational downward force to move along with the leg portion alongside which they have been situated. In respect to the male and female pelvis, during certain leg and body movements it cannot be totally avoided for the crotch seam to cut and pull into the perineum. This type of trouser construction makes closely fitted trousers most uncomfortable to wear, especially for men, without today's supportive briefs, featuring elastic fabric with a centered supportive pouch section designed to hold the genitals tightly packed against the pelvis. This concept: to wear the genitals centered, sideways or upwards, firmly held against the pubic area, is very popular today; it allows men to wear closely fitted trousers with a centered crotch seam and fly.

Prior art which relates somewhat to my invention can be found in the field of pajama and underwear construction, as shown for example in U.S. Pat. Nos. 2,239,972; 2,306,514. These constructions provide a combination crotch/fly panel, extending from the waistband in front to the waistband in the rear, and are meant solely as underwear and sleep wear, are loosely fitted in the case of pajamas or are meant to be fabricated from stretchable fabric as related to underwear. These constructions provide comfort and support for the male genitals by substituting a centered crotch seam with crotch panels or combined crotch/fly/rear panels of various shapes and configurations, thus preventing the conventional centered crotch seam to cut and pull into the perineum and genitals during leg and body movement.

U.S. Pat. No. 2,702,545 does comprise a novel approach to the construction of the crotch by inserting in the perineal area a gusset or support piece, thus eliminating a centered crotch seam overlying the perineum. A separate, flat, centered front panel is inserted in the abdominal region between the two leg portions and is connected to the gusset piece along a U-shaped marginal edge. This construction serves to provide a separate and laterally extending crotch section, however the shapes and configuration of this construction do not provide the results achieved by the applicant's invention. Also, its complicated joinery and detailing does not lend itself for inexpensive and easy mass production.

Accordingly, it is an object of my invention to provide a novel trouser construction, closely fitted to the anatomy of the pelvic structure, by substituting a centered crotch and fly seam with a separate panel, overlying the perineum and genitals and acting like an accordion in the perineal area during leg movement, thus eliminating any possible stresses from a centered crotch seam cutting and pulling into the perineum and genitals, especially during leg raising, leg bending, deep knee bending and during body postures like sitting on a chair or in a car seat, sitting in the cross-legged or lotus position, or the squat position.

Another object of my invention is to provide a novel trouser construction around the pelvis to give support and protection to the genitals, similar to a large shallowly cupped hand firmly but gently held over the genitals, by substituting the conventional crotch and fly construction with a combination crotch/front panel.

Yet another object of my invention is to provide a novel trouser construction around the pelvis to allow for better ventilation of the perineal-genital area by eliminating the need of tight elastic briefs or other devices for the support of the male genitals: such undergarments are superfluous with said novel construction of crotch and front.

Yet another object of my invention is to provide a novel trouser construction around the pelvis to allow for an improved anatomical fit in the crotch region while cost of fabrication is lower than for most other prior art constructions due to the simplicity of the construction engineering.

SUMMARY OF THE INVENTION

In accordance with an aspect of my invention a pair of anatomically fitted trousers with an improved construction of the crotch and genital region is consisting of two leg portions, a waistband and a novel combination crotch/front panel. The leg portions are suspended from the waistband above and are fitted closely around each upper thigh and buttock and are joined together in the center rear by a seam following closely the contour line of the pelvic sagittal section to a point near the anus. Starting at said point a triangular cutout is provided, exposing perineum, genitals, pubic area and abdomen above up to the waistband. A combination crotch/front panel, acting like a large shallowly cupped hand held over the genitals and functioning like an accordion in the perineal area during leg movement, comprised of two oblong convexly curved or straight sides and a short concavely curved or straight side, is inserted into said cutout, thus connecting the two leg portions from said point near the anus on up to the front portion of the waistband. This novel construction follows the anatomical properties of the pelvis and is engineered to conform to physical requirements and specifications of the pelvis in respect to leg and body movement.

BRIEF DESCRIPTION OF THE DRAWINGS

The above and other features and advantages of this invention will be apparent in the following detailed description of an illustrative embodiment thereof which is to be read in connection with the accompanying drawings, wherein.

DETAILED DESCRIPTION OF THE INVENTION

Figure 4:
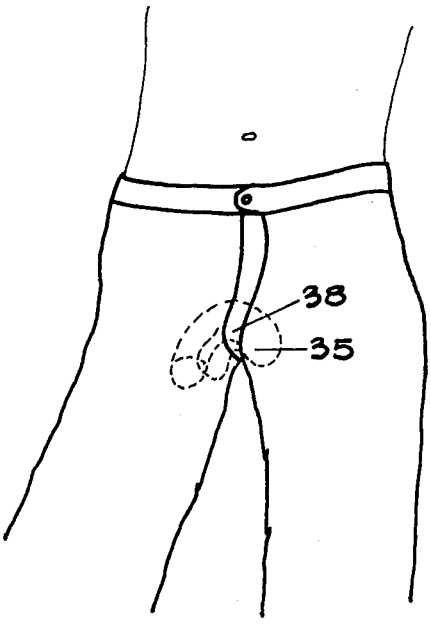
FIG. 4 is a front perspective view of conventional closely fitted trousers with centered crotch and fly construction cutting into underlying perineum and male genitals.
Figure 3:
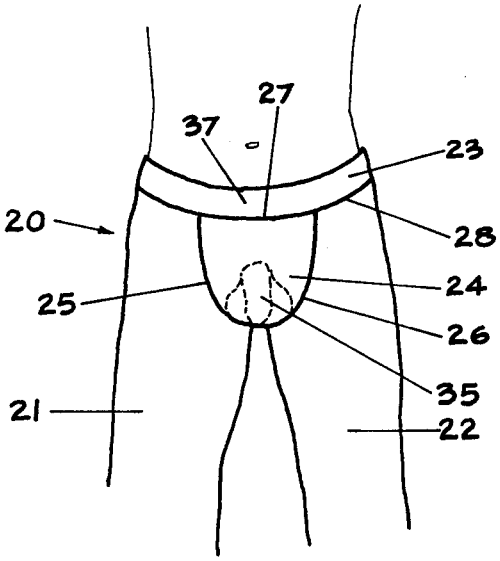
FIG. 3 is a front perspective view as in FIG. 1 showing placement of underlying male genitals.
Figure 5:
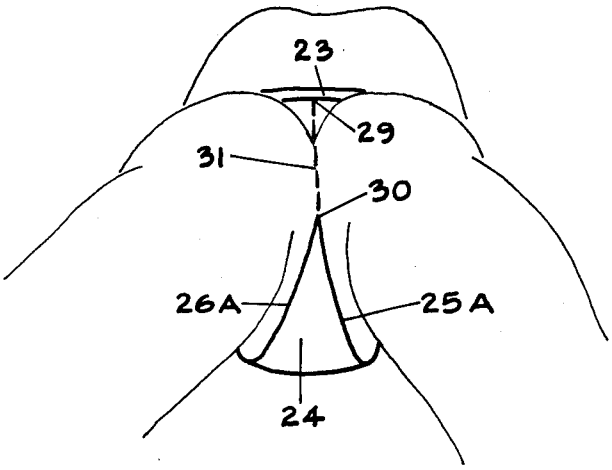
FIG. 5 is a rear perspective view of FIG. 1 taken from below the crotch with the leg portions removed.
Figure 6:
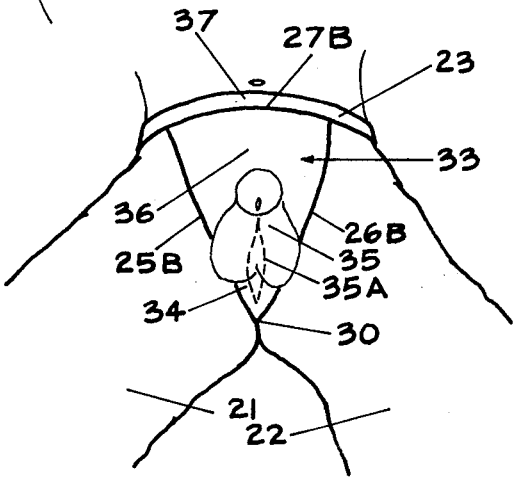
FIG. 6 is a front perspective view of FIG. 1 taken from below the crotch with the combination crotch/-front panel removed, showing male and female genitals.
Figure 7:
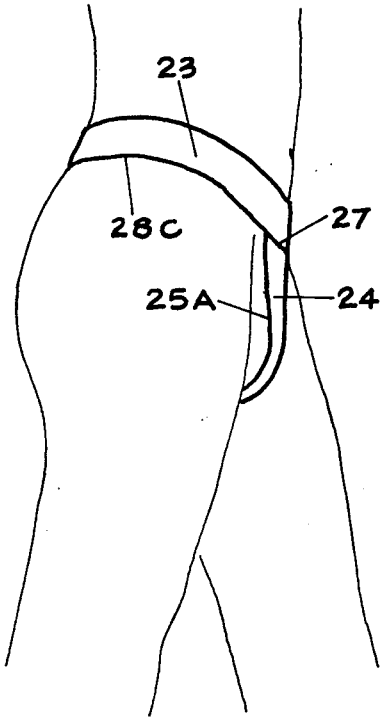
FIG. 7 is a side perspective view of FIG. 1 with the leg portions removed.
Figure 8:
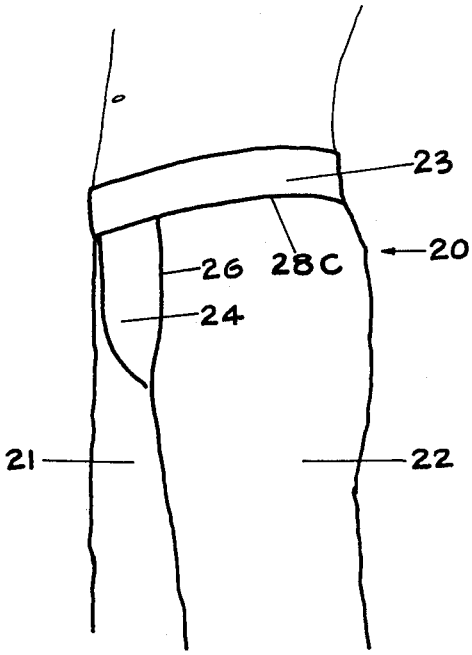
FIG. 8 is a side perspective view of FIG. 1.

Referring now to the drawings in detail, and initially to FIGS. 1–8, 12, 13, a trouser construction 20 is shown with the leg portions 21,22, a waistband 23, defining the waistline, and a triangular combination crotch/front panel 24, having two oblong convexly curved sides 25A,26A or straight sides 25C, 26C and a short horizontal concavely curved side 27A or straight side 27C. The leg portions 21,22 are joined to the waistband 23 along seam 28 connecting edges 28A, 28B of the leg portions to edge 28C of waistband 23. In the center rear starting at point 29 they are joined together down to point 30 near the anus, following the contour line 31 of the sagittal section of the pelvis to form seam 32, connecting edges 32A,32B of the leg portions 21,22. Starting at point 30 near the anus a triangular cutout 33 between the leg portions 21,22 is provided, first defining the triangular outlines of the perineum 34 and exposing the female genitals 35A, then exposing the male genitals 35 and pubic and abdominal area 36 above up to a front portion 37 of waistband 23, as illustrated in FIG. 6. The combination crotch/front panel 24 is inserted into said cutout starting at point 30, connecting edge 25A or edge 25C to edge 25B to form seam 25, edge 26A or edge 26C to edge 26B to form seam 26 and edge 27A or edge 27C to the lower edge 27B of the frontal portion 37 of the waistband 23, thus connecting the leg portions 21,22 from point 30 up to the waistband 23.

Figure 1:
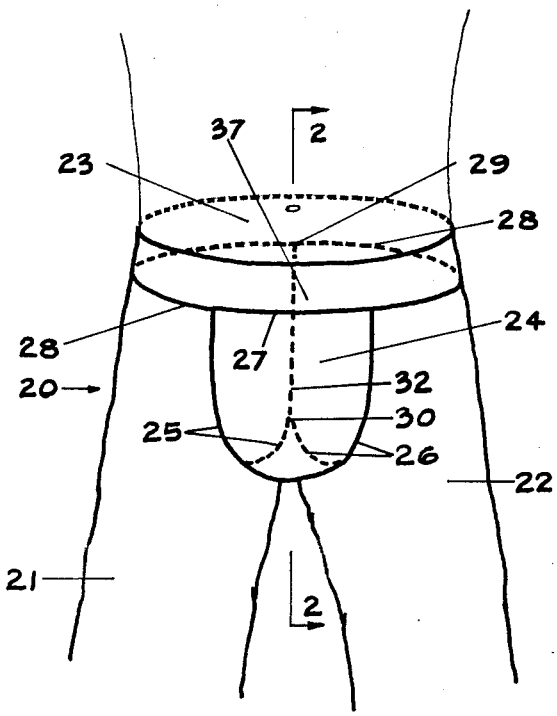
FIG. 1 is a diagrammatic front perspective view of a trouser construction in accordance with the present invention.
Figure 2:
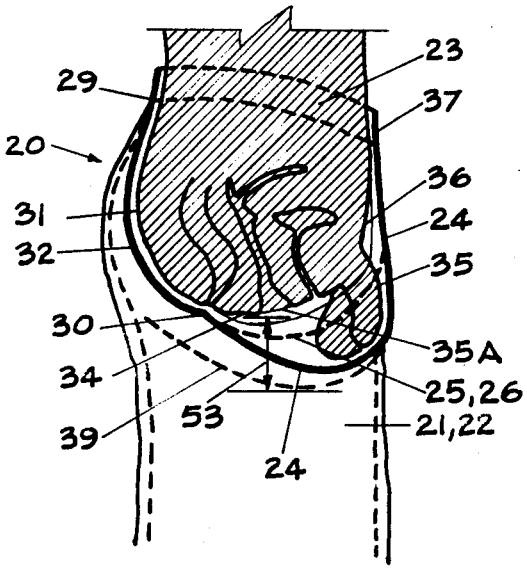
FIG. 2 is a vertical diagrammatic section along lines 2—2 of FIG. 1 illustrating the underlying contour line of the sagittal section of male and female pelvis combined.

A conventional construction of crotch and fly of closely fitted trousers is illustrated in FIG. 4. A centered crotch and fly joint 38 of the leg portions is pulling and cutting into the underlying male genitals 35 and into the perineum during leg and body movement. The perineum and genitals are located medially at the frontward outlet of the pelvis. A centered crotch seam which is too closely fitted against the perineum unavoidably cuts into the perineum during leg and body movement due to the shortening and lengthening of critical dimensions in the pelvic area, even when the male genitals have been located centrally above the crotch seam by using supportive briefs of elastic fabric. This concept restricts body movement, gives a restricted and tight feeling around the pelvis and prevents adequate ventilation of the perineal area. A low crotch seam 39, as shown in FIG. 2, kept well below the genitals, is not suited for closely fitted trousers due to the offset 53 of the leg hinge area at the perineum 34 and the low crotch seam 39 acting as a hinge for the leg portions. A loosely fitted design around legs and buttocks is required for this concept.

In the construction of anatomically fitted trousers, permitting free and unobstructed leg movement and allowing certain postures like the cross-legged position and the lotus position, squatting, sitting in chairs and car seats, etc. without tension in the crotch, the rear seam 32, acting as a hinge for the leg portions 21,22, overlies closely the rear upper portion of the contour line 31 of the sagittal section of the pelvis, representing the overlapping leg hinge lines between the buttocks, as shown in FIGS. 2, 5. At a point 30 near the anus the leg hinge lines diverge, first defining the outlines of the perineum and then curving around the upper inner area of the thighs and finally along the groins, leaving between them the perineum, genitals and pubic area and lower abdomen. The two off-center crotch seams 25,26 are situated over these natural hinge lines for the legs in the crotch area and along the lower portion of the groins. Thus the triangular cutout 33, including perineum 34 and genitals 35,35A, remains free, unobstructed and undisturbed during leg and body movement, as shown in FIG. 6. Perineum and genitals are part of the stationary body mass of the pelvis in respect to the moveable legs. The combination crotch/front panel 24, acting like a shallowly cupped hand holding the male genitals gently in their natural downward position against the pelvis and functioning like an accordion in the perineal area during leg movement, is inserted into the cutout 33, as shown in FIGS. 1, 2, 3, 5, 7, 8. This natural concept follows anatomical facts and human engineering requirements of legs and pelvis and gives the user maximum freedom of leg movement and maximum support, comfort and protection of perineum and genitals, while allowing for loosely fitted underwear, and makes the use of elastic briefs and other support devices like jock straps and athletic supports superfluous.

Figure 13:
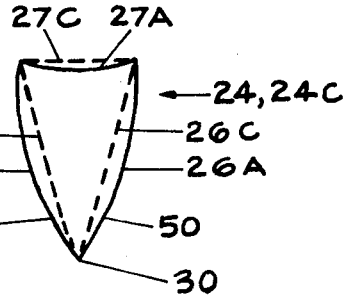
FIG. 13 is a plan view of the combination crotch/-front panel pattern of FIG. 1.

My novel trouser construction has been conceived for men and women. The vulva is located medially inside the area of the perineum. A centered and closely fitted crotch seam of conventional trouser construction pulls into the perineum and cuts into the labial folds of the vulva. It is therefore envisioned that also women will prefer to wear trousers constructed according to my invention. The shape of the oblong edges of the combination crotch/front panel 24C, as in FIG. 13, is substantially straight to fit over the shallow bulge of the mons veneris and is increasingly convexly curved according to increasingly larger sizes of the male genital bulge.

Figure 9:
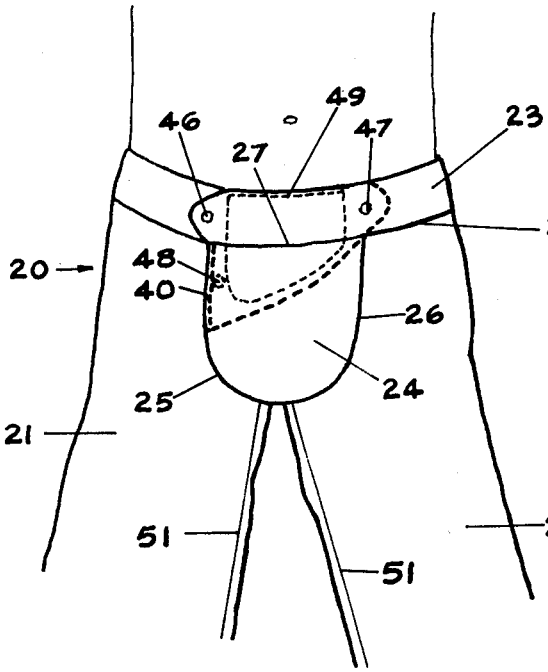
FIg. 9 is a front perspective view of FIG. 1 illustrating one particular embodiment of a fly aperture.
Figure 10:
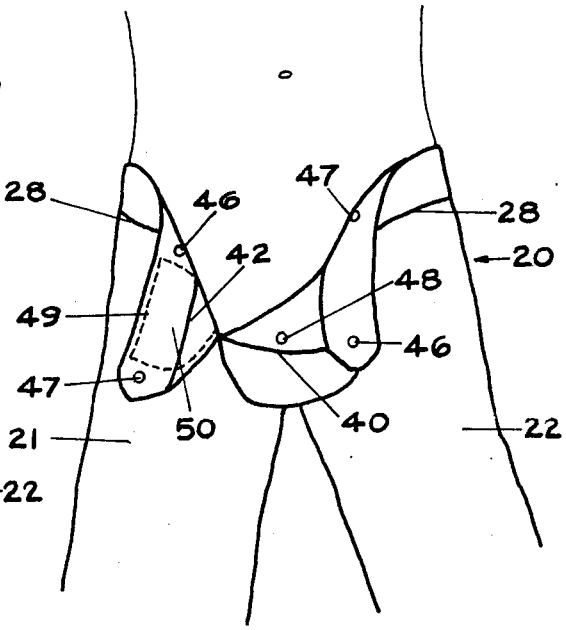
FIG. 10 is a front perspective view of FIG. 9 showing the fly in an open position.
Figure 11:
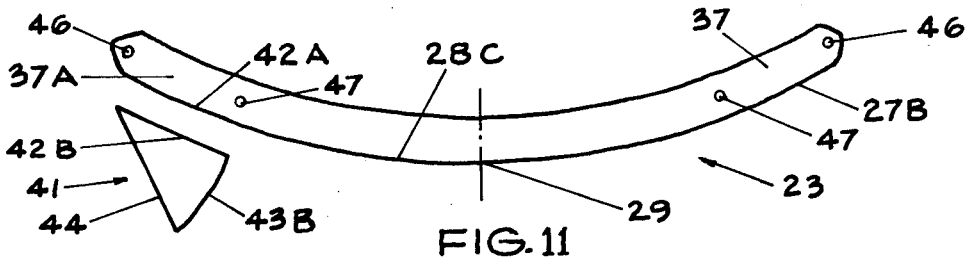
FIG. 11 is a plan view of the waistband and tie piece patterns of FIGS. 9, 10.
Figure 12:
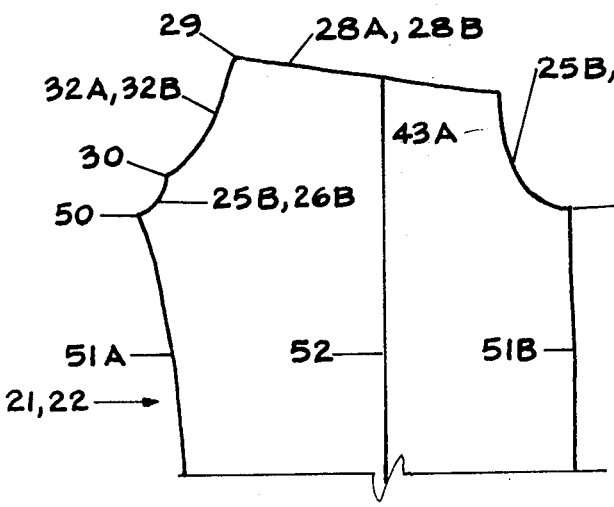
FIG. 12 is a plan view of the right leg portion pattern of FIG. 1.

Referring now to FIGS. 9–13, one embodiment of my invention with a particular fly construction is illustrated. Leg portions 21,22 are formed from a flat pattern, as in FIG. 12, by connecting edges 51A,51B starting at point 50 to form seams 51 along the inside of the legs. Seam 52, located along the outside of the leg, or any other seams, located anywhere and shaped in any manner, can be used to make up the tubular leg portions. FIGS. 9, 10 illustrate a fly aperture 40 located on the right side along the upper part of seam 25. Front portion 37 of waistband 23 has overlapping sections with an underlying portion 37A, as shown in FIG. 11. A triangular shaped tie piece 41, underlying a top portion of the combination crotch/front panel 24 near seam 27 has two oblong edges 42B,44 and a short edge 43B. Edge 42B is joined to lower edge 42A of underlying portion 37A of waistband 23 to form underlying tie section 50. Edge 43B is joined to the upper portion 43A of edge 25A of leg portion 21, as shown in FIGS. 11, 12. Fastening means 46,47,48 like buttons, snaps or other suitable means like zipper, velcro, hooks, etc. for alternately opening and closing waistband 23 and fly opening 40 can be provided. Of course fly aperture 40 can be located on the left side as well. Other fly locations like at the sides, rear or front can be also provided. A money pocket 49 has been provided in the underlying tie section 50. However other pockets can be located anywhere, wherever desired. Belt loops can be attached along the waistband at any desired location for use with a belt.

Although an illustrative embodiment of the present invention has been described herein with reference to the accompanying drawings, it is to be understood that the invention is not limited to that precise embodiment and that various changes and modifications may be effected therein by one skilled in the art without departing from the scope or spirit of this invention.

What is claimed is:

1. An anatomical trouser construction made of substantially non-stretchable material closely fitted around the pelvic region consisting of two leg portions and a combination crotch/front panel; said leg portions being suspended near the waistline and being closely fitted around each upper thigh and buttock and being joined together in the rear by a medial seam following closely the contour line of the median sagittal section of the pelvis inside the crease between the buttocks to a point near the anus; a triangular cutout being provided between said leg portions having its apex at said point near the anus exposing perineum, genitals, pubic area and the lower abdominal area above up to the waistline, said cutout being defined by two oblong edges converging at said point near the anus and a horizontal edge following the curvature of the abdominal waistline, said two oblong edges having lower curved portions where bordering perineum, genitals and pubic area and having vertical upper edge portions below the waistline in the abdominal area; said combination crotch/front panel having two converging oblong convexly curved or straight edges and a concavely curved or straight edge along the waistline, said converging oblong convexly curved or straight edges having upper vertical edge portions below the waistline, the respective oblong edges of said cutout and said combination crotch/front panel being joined together forming two off-center combined crotch/front seams, said combination crotch/front panel having a front portion and a crotch portion, said crotch portion overlying the perineum and acting like an accordion between the edges of said cutout near the perineum during leg movement, said front portion having a lower portion acting like a curved supportive panel held over genitals and pubic area.

2. A trouser construction as defined in Claim 1 wherein said upper edge portions of said cutout and of said combination crotch/front panel adjoining each other respectively in the abdominal area below the waistline; a fly being provided along either or both of said upper adjoining edge portions comprising the overlapping flaps of said fly; fastening means being attached alongside said overlapping flaps for alternately fastening and unfastening said fly.

3. A trouser construction as defined in claim 2 wherein a tie piece is being joined to an underlying portion of said overlapping flaps, said tie piece traversing the abdomen near the waistline and underlying a top portion of said combination crotch/front panel and having fastening means for fastening and unfastening said tie piece to an overlying portion of said trouser construction.

4. A trouser construction as defined in claim 3 wherein said tie piece has a pocket formed therein.

5. A trouser construction as defined in claim 1 wherein said leg portions are being suspended near the waistline from a waistband, said waistband having overlapping sections in the abdominal area near said cutout and having fastening means for alternately fastening and unfastening said overlapping portions.

6. A trouser construction as defined in claim 1 wherein belt loops being attached along the marginal upper edge of said leg portions near the waistline allowing the user to suspend said trouser construction near the waistline from a belt.

* * * * *